US005308081A

United States Patent [19]

Bartle

[11] Patent Number: 5,308,081

[45] Date of Patent: May 3, 1994

[54] METHOD OF PLAYING A THREE DICE BETTING GAME

[76] Inventor: Richard J. E. Bartle, 2 Grenoble Place, Ormonde 2091, Johannesburg, Transvaal, South Africa

[21] Appl. No.: 788,475

[22] Filed: Nov. 6, 1991

[30] Foreign Application Priority Data

Nov. 7, 1990 [ZA] South Africa ..... 90/8917

[51] Int. Cl.[5] ..... A63F 3/00

[52] U.S. Cl. ..... 273/274

[58] Field of Search ..... 273/309, 274, 287, 146, 273/138 R

[56] References Cited

U.S. PATENT DOCUMENTS

| | | | |
|---|---|---|---|
| D. 180,186 | 4/1957 | Grobauer | D34/5 |
| D. 183,007 | 6/1958 | Lord | D34/5 |
| 3,667,757 | 6/1972 | Holmberg | 273/274 |
| 3,829,098 | 8/1974 | Umminger | 273/274 |
| 4,247,114 | 1/1981 | Carroll | 273/274 |
| 4,312,508 | 1/1982 | Wood | 273/146 |
| 4,334,685 | 6/1982 | Robbins | 273/274 |
| 4,346,900 | 8/1982 | Lamlee | 273/274 |
| 4,635,938 | 1/1987 | Gray | 273/146 |
| 4,902,019 | 2/1990 | Berman | 273/256 |

*Primary Examiner*—Benjamin H. Layno
*Attorney, Agent, or Firm*—McGlew and Tuttle

[57] ABSTRACT

The method of playing the betting game includes providing a playing surface, betting tokens and dice. The playing surface has three types of betting zones demarcated on it. The first type of betting zone has a representation corresponding to a result obtainable from the throw of one dice. The second type of betting zone has a representation corresponding to a result obtainable from the throw of two dice or of the second dice with reference to the first dice. The third type of betting zone has a representation corresponding to a result obtainable from the throw of three dice. Bets are placed sequentially on the respective betting zones before each of the three dice is thrown.

2 Claims, 1 Drawing Sheet

METHOD OF PLAYING A THREE DICE BETTING GAME

FIELD OF INVENTION

This invention relates to a method of playing a three dice betting game.

DISCUSSION OF THE PRIOR ART

U.S. Pat. No. 4,334,685 (Robbins et al) describes a three dice wagering game. In this game three dice (two white dice and one red dice) are thrown simultaneously. The players can bet on the various different results which can be obtained by throwing these three dice simultaneously. The Applicant has found that the excitement generated while playing the game can be greatly increased if the players place bets before throwing each of the dice. This also provides the players with many more different types of results upon which they can bet.

OBJECT OF THE INVENTION

It is an object of the invention to provide a method of playing a three dice betting game in which the players can place bets before throwing each of the dice.

SUMMARY OF THE INVENTION

According to the invention a method of playing a betting game includes the steps of:

- providing a playing surface, betting tokens and dice, the playing surface having three types of betting zones demarcated on it, the first type of betting zone having a representation corresponding to a result obtainable from the throw of one dice, the second type of betting zone having a representation corresponding to a result obtainable from the throw of two dice or of the second dice with reference to the first dice, the third type of betting zone having a representation corresponding to a result obtainable from the throw of three dice;
- placing at least one bet with at least one betting token on a first, second and/or third type of betting zone;
- throwing a first dice and determining the result obtained from the dice;
- placing at least one bet with at least one betting token on a second and/or third type of betting zone;
- throwing a second dice and determining the cumulative result obtained from the first and second dice or the result of the second dice with reference to the first dice;
- placing at least one et with at least one betting token on a third type of betting zone;
- throwing a third dice and determining the cumulative result obtained from the first, second and third dice;
- determining winners and/or losers after having determined the result obtained from the first, second and/or third dice;
- paying out the winners.

The method preferably includes the step of electing one of the players as a banker to control the distribution of the playing tokens during the game.

BRIEF DESCRIPTION OF THE DRAWING

The drawing is a plan view of one embodiment of the playing surface used in the playing of the game.

DETAILED DESCRIPTION OF THE PREFERRED METHOD OF PLAYING THE GAME

Figure 1:
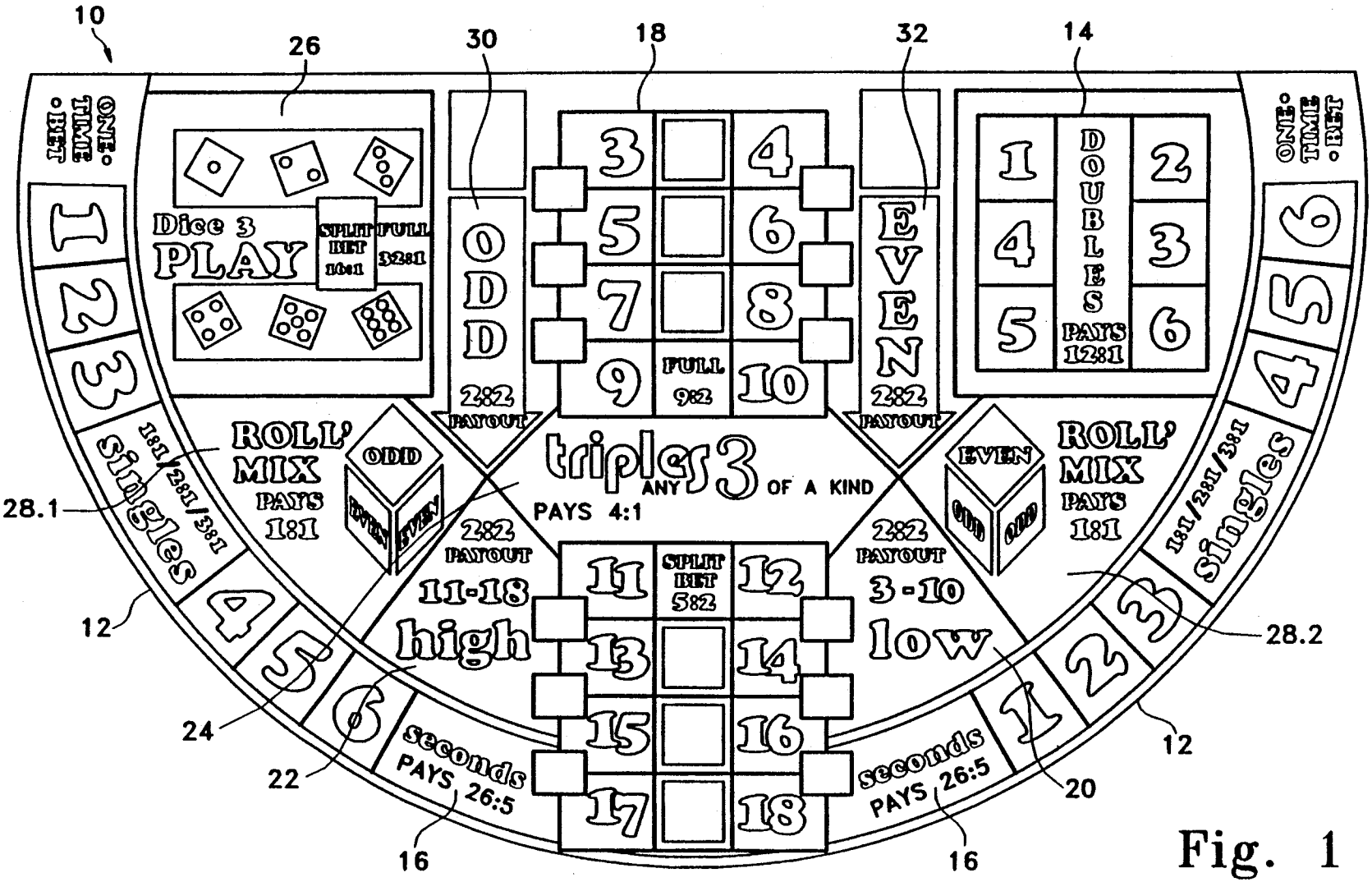

The playing surface 10 has numerous betting zones each with representations corresponding to a type of result obtainable from throwing the dice.

The first type of betting zone is a singles betting zone and is shown by reference numeral 12. Two of these singles betting zones 12 are provided. Each singles betting zone 12 has the numerals 1 to 6 provided within it. The players place their bets in the form of betting tokens on any one or more of these numerals before throwing the first dice. Any player who has placed a betting token on the numeral which is shown on the first dice will be regarded as a winner.

Two different second type betting zones are provided. The first of the second type betting zones is a doubles betting zone and is shown by reference numeral 14. The doubles betting zone 14 has the numerals 1 to 6 provided within it. If, after two dice have been thrown, and the results of the two dice are identical, any player who has placed a betting token on the numeral which is shown on both dice will be regarded as a winner. The players can only bet on the doubles betting zone before the first dice is thrown. An alternative form of this betting zone 14 would comprise six different sets of alike numerals within it.

The second of the second type of betting zones is a seconds betting zone and is shown by reference numeral 16. Two of these seconds betting zones 16 are provided. A player can place a bet on the seconds betting zone 16 after the first dice has been thrown. The player will be regarded as a winner if the result obtained from the throw of the second dice is the same as that obtained by the throw of the first dice or if the result obtained by the throw of the second dice is a 3.

Eight different third type betting zones are provided.

The first of the third type betting zones is a totals betting zone and is shown by reference numeral 18. The totals betting zone has the numerals 3 to 18 located within it. A player can place betting tokens on any of these numerals before the first, second or third dice are thrown. A player who has placed a betting token on the numeral which reflects the cumulative total of the three dice will be regarded as a winner. Players have the option of splitting their bets in the totals betting zone 18 by placing their betting tokens between any two adjacent numerals.

The second of the third type betting zones is a low range of totals betting zone and is shown by reference numeral 20. The low range of totals betting zone 20 has the representation 3–10 providing on it. Players can place their betting tokens on this betting zone 20 only before the first dice is thrown. If the cumulative total of the three dice is between 3 and 10 inclusive, a player who placed a betting token on this betting zone 20 will be regarded as a winner.

The third of the third type betting zones is a high range betting zone and is shown by reference numeral 22. This betting zone 22 has the representation 11–18 located on it. The method of betting on the high range betting zone 22 is the same as that for the low range betting zone 20 except that the cumulative total of the three dice must be between 11 and 18 inclusive.

The fourth of the third type betting zones is a non-specific triples betting zone and is shown by reference numeral 24. If the numbers on each of three dice is the same, a player who has placed a betting token on this betting zone 24 will be regarded as a winner. A player can place his betting tokens on this betting zone 24 before the first, second or third dice are thrown. Although not shown, a modified version of the non-specific triples betting zone 24 is provided in the form of a specific triples betting zone. The representation of the specific triples betting zone comprises representations of each face of the dice. If the numbers on all three dice are the same, a player with a betting token on the corresponding representation will be regarded as a winner. A player can also split his bet by placing his betting token between two adjacent representations of the faces of the dice.

The fifth of the third type betting zones is a specific triple combination betting zone and is shown by reference numeral 26. This betting zone 26 includes two sets of representations, each comprising a combination of three faces of the dice. A player placing a betting token on the correct combination or by splitting his bets between the two combinations will be regarded as a winner. A player can only place his betting tokens on this betting zone before the first dice is thrown.

The six of the third type betting zones is a combination of odds and evens betting zone and is shown by reference numerals 28.1 and 28.2. A player can place a betting token on these betting zones before the first, second or third dice are thrown. Betting zone 28.1 has a representation depicting a combination of two evens and one odd. Betting zone 28.2 has a representation depicting a combination of two odds and one even. A player who has placed a betting token on the correct combination of the three dice will be regarded as a winner.

The seventh of the third type betting zones is an odd betting zone and is shown by reference numeral 30. A player can place a betting token on this betting zone before the first, second or third dice are thrown. If the cumulative total of the three dice is an odd number, a player who has placed a betting token on this betting zone 30 will be regarded as a winner.

The eighth of the third type betting zones is an event betting zone and is shown by reference numeral 32. The method of betting on this betting zone 32 is similar to that for the odd betting zone 30, except that the cumulative total of the three dice must be an even number for a player to be regarded as a winner.

It will be appreciated that many modifications or variations of the invention are possible without departing from the spirit or scope of the invention.

I claim:

1. A method of playing a betting game including the steps of:

providing a playing surface, betting tokens and dice, the playing surface having three types of betting zones demarcated on it, the first type of betting zone having a representation corresponding to a result obtainable from the throw of only a first die, the second type of betting zone having a representation corresponding to a result obtainable from the throw of only two dice or of only a second die with reference to the first die, the third type of betting zone having a representation corresponding to a result obtainable from the throw of three dice;

placing at least one bet with at least one betting token on a first, second or third type of betting zone;

throwing only a first die and determining the result obtained from the first die;

placing at least one bet with at least one betting token on a second and/or third type of betting zone;

throwing only a second die and determining the cumulative result obtained from the previous result obtained from the first die and the result obtained from the second die or the result of the second die with reference to the previous result obtained from the first die;

placing at least one bet with at least one betting token on a third type of betting zone;

throwing only a third die and determining the cumulative result obtained from the previous results obtained from the first and second dice and the results obtained from the third die determining winners and/or losers after determining winners and/or losers after having determined the results obtained from the first, second and/or third dice and after having evaluated the placement of the betting tokens on the betting zones; and paying out the winners.

2. The method of claim 1 including the step of electing one of the players as a banker to control the distribution of the playing tokens during the game.

* * * * *